United States Patent [19]

Dulyea, Sr.

[11] Patent Number: 5,029,703

[45] Date of Patent: Jul. 9, 1991

[54] GOLF CLUB ORGANIZER

[76] Inventor: Kenneth W. Dulyea, Sr., 5159 Brookside Ct., Whitehall, Mich. 49461

[21] Appl. No.: 437,098

[22] Filed: Nov. 16, 1989

[51] Int. Cl.[5] ..... A63B 55/00

[52] U.S. Cl. ..... 206/315.3; 206/315.6; 211/70.2; 24/336

[58] Field of Search ..... 206/315.2, 315.3, 315.6, 206/315.8; 273/32 E; 211/70.2; 383/38, 40; 24/336, 545, 555

[56] References Cited

U.S. PATENT DOCUMENTS

| | | | |
|---|---|---|---|
| 1,570,500 | 1/1926 | Kennedy . | |
| 1,756,902 | 4/1930 | Boyce . | |
| 2,128,546 | 9/1938 | Venmore . | |
| 2,143,644 | 1/1939 | Borm . | |
| 2,482,372 | 9/1949 | Rossow | 206/315.2 |
| 2,551,780 | 5/1951 | Wood . | |
| 3,110,066 | 11/1963 | Ward et al. | 24/545 |
| 3,139,132 | 6/1964 | Shiller . | |
| 3,503,518 | 3/1970 | Black . | |
| 4,181,167 | 1/1980 | Ret | 206/315.6 |
| 4,667,820 | 5/1987 | Solheim | 206/315.3 |
| 4,673,082 | 6/1987 | Hemme . | |
| 4,753,344 | 6/1988 | Antonious | 206/315.3 |
| 4,753,446 | 6/1988 | Mills | 206/315.6 |
| 4,852,896 | 8/1989 | Mills | 206/315.3 |
| 4,864,697 | 9/1989 | Sparks et al. | 24/336 |
| 4,881,638 | 11/1989 | Cho | 206/315.3 |
| 4,915,221 | 4/1990 | Spangler | 206/315.3 |

*Primary Examiner*—David T. Fidei

*Attorney, Agent, or Firm*—Dennison, Meserole, Pollack & Scheiner

[57] ABSTRACT

A golf bag organizer comprising a base with a plurality of upwardly directed sockets adapted to mount within a golf bag either directly or through a size-adjustable adapter ring. A rack with peripherally positioned club retainers mounts in the bag over the base with the retainers aligned with the base sockets. A vertical partition may be provided between the rack and the base. A traveling lock ring selectively snap-locks to the rack for a positive retention of the clubs therein until the lock ring is manually removed.

17 Claims, 4 Drawing Sheets

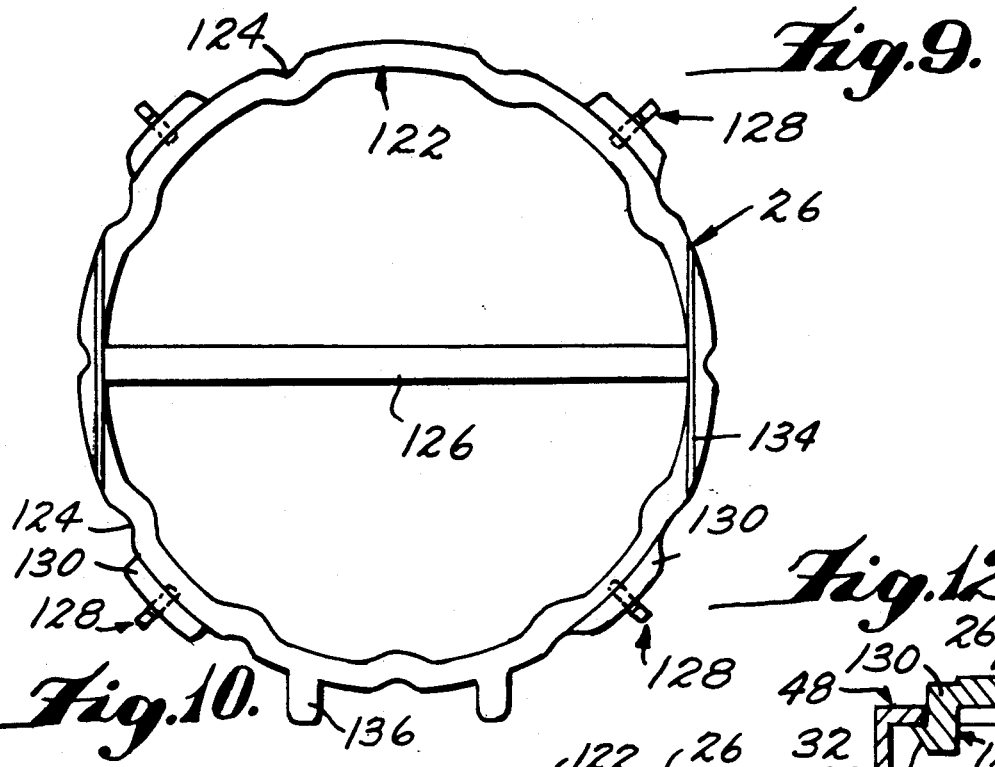
Fig.9.
Fig.10.
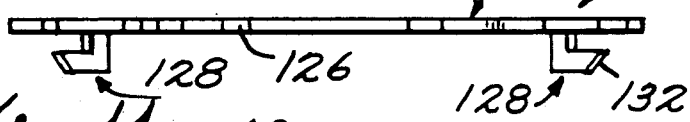
Fig.11.
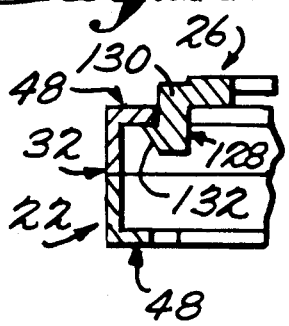
Fig.12.
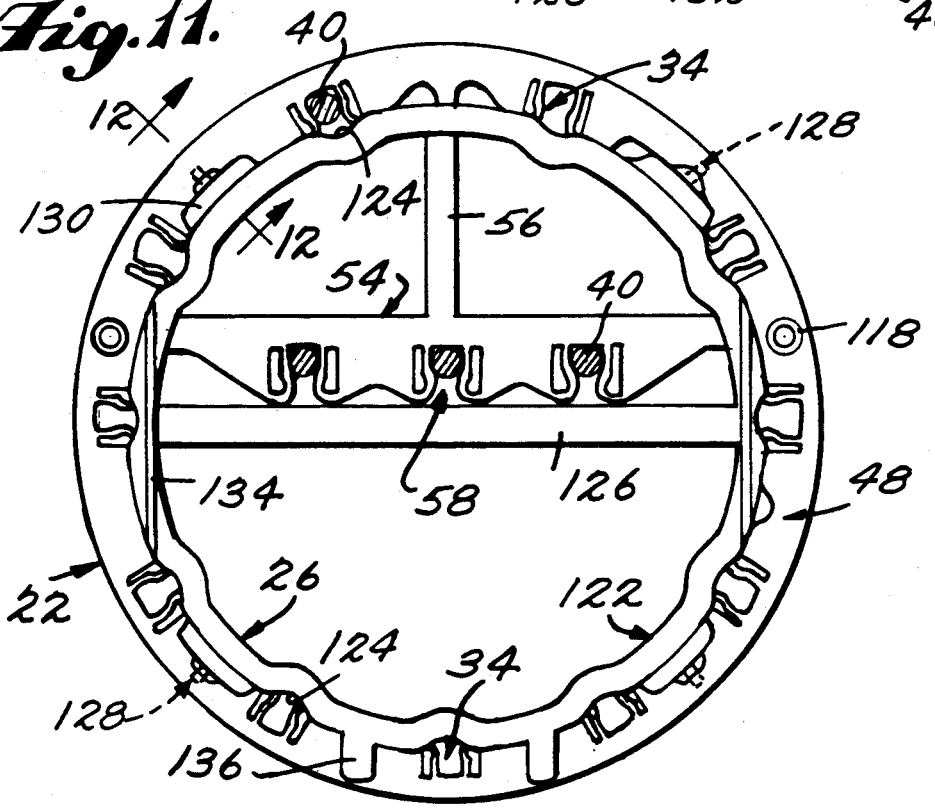

GOLF CLUB ORGANIZER

BACKGROUND OF THE INVENTION

Golf clubs are conventionally carried in open-topped bags which receive the club shafts with the club heads upwardly directed for easy identification and access thereto.

Such bags, in themselves, loosely receive the clubs therein with the clubs, without internal supports, freely engaging against each other, resulting in scuffing of the club grips, possible chipping or denting of the club heads, and "club chatter" as the bag is being carried.

Many solutions have been proposed in the nature of racks, separator tubes and the like positioned within the bag and releasably receiving the individual clubs. Such devices, while found to be practical and acceptable under some circumstances, do not accommodate to all of the conditions to which a golf bag is normally subjected. For example, the provision of clips or retainers within the upper portion of the bag for engagement immediately adjacent the club heads will not normally protect the club grips at the base of the bag. Also, if the grip is to be such as to allow for a substantial ease in inserting and removing the club, as desired during the playing of the game, the retention of the club is not such as to retain the club during the substantially greater disruptive forces to which the bag is subjected during a transporting of the bag, for example in the trunk of a car. If, to the contrary, a sufficient grip is provided for the club to prevent the possibility of accidental release, this would not provide the desired free and rapid access to the clubs as the game is being played.

SUMMARY OF THE INVENTION

The golf club organizer of the invention, mountable within the upper portion of a conventional golf bag, incorporates a unique rack for engagement with the club shaft, immediately below the head, in a manner whereby the club is gripped at vertically spaced positions to provide a substantial degree of stability against pivotal movement of the shaft within the bag. At the same time, the grip is such as to allow for a substantial ease of both insertion and removal of the club.

In order to stabilize the clubs for transportation or other extremely heavy handling situations, a separate lock ring is provided which, subsequent to a positioning of the clubs in the rack, quickly and easily snap-locks into the rack to positively close each of the club retainers and effect a corresponding retention of the clubs therein. When the clubs are to be used in the playing of the game, the lock ring is merely snap-released to "open" or unlock the retainers.

The organizer also utilizes, as desired, a molded base defining a plurality of upwardly directed sockets generally aligned with the retainers of the overlying rack for reception and separation of the club grips. An appropriate divider, engaged with and extending between the base and the rack, can also be provided.

In order to accommodate bags of varying diameters, appropriate spacers are provided for use with the upper rack, and an adapter ring provided for use with the base.

All of the components are formed of an appropriate synthetic resin, for example resilient polypropylene.

Other features, objects and advantages of the invention will be recognized from the more detailed description of the invention following hereinafter.

BRIEF DESCRIPTION OF THE DRAWINGS

FIG. 9 is a top plan view of the lock ring;

FIG. 10 is a side elevational view of the lock ring;

FIG. 11 is a top plan view of the lock ring mounted to the rack in a manner so as to fix the club shafts within the retainers;

FIG. 12 is a cross-sectional detail illustrating the manner of releasably fixing the lock ring to the rack;

DESCRIPTION OF PREFERRED EMBODIMENT

Figure 1:
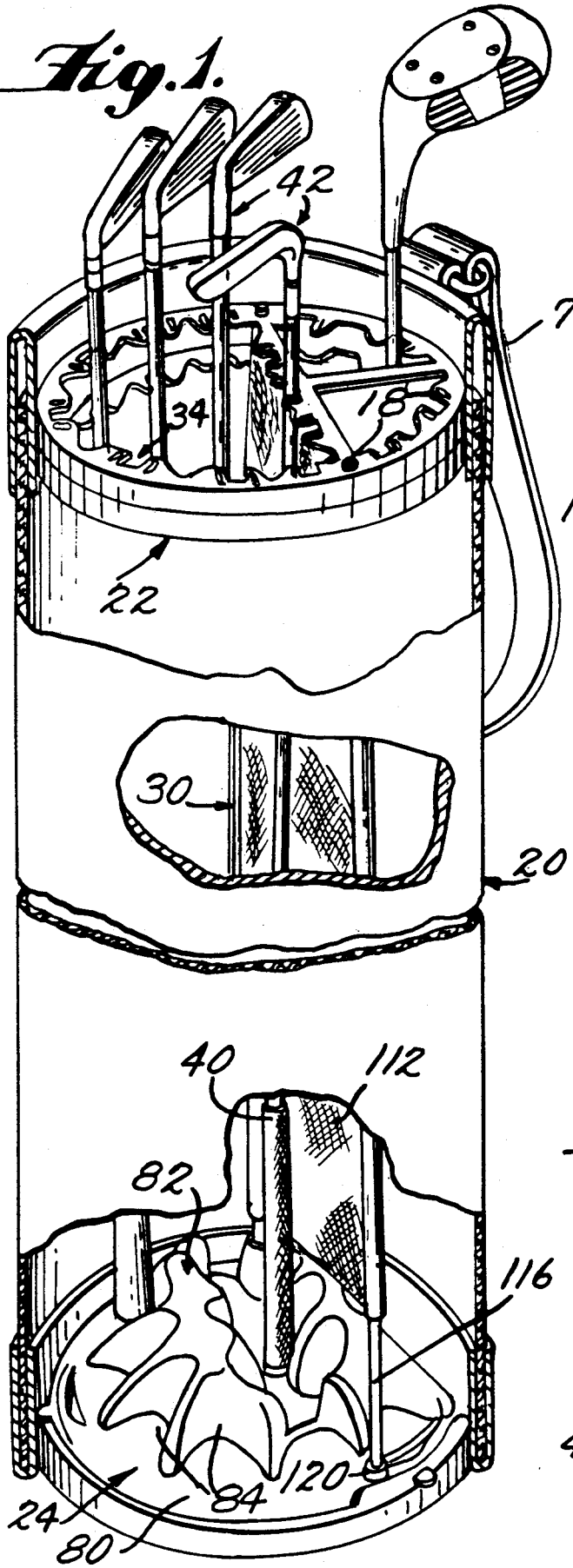
FIG. 1 is a perspective view of a golf bag, with portions broken away and with the organizer mounted therein.

Referring more specifically to the drawings, FIG. 1 illustrates a conventional golf bag 20 with selected components of the organizer of the invention mounted therein. The organizer includes a rack 22 mountable within the upper portion of the bag 20 inward of the open mouth thereof, a base 24 positioned within the closed bottom of the bag 20, a lock ring 26, noting FIG. 11, selectively engaged with the rack 22, and an adapter ring 28, noting FIG. 13, engageable with the base 24 to accommodate larger sized bags 20. Finally, the organizer can incorporate a partition or divider 30 engaged with and extending between the rack 22 and base 24.

Figure 2:
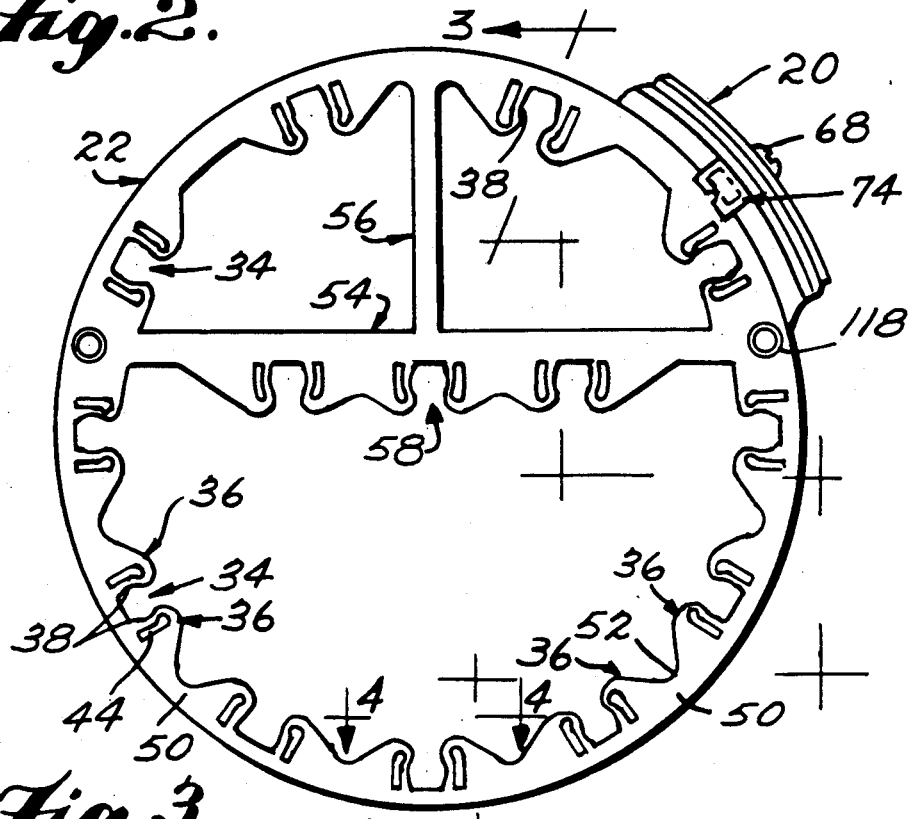
FIG. 2 is a top plan view of the rack component of organizer.
Figure 3:
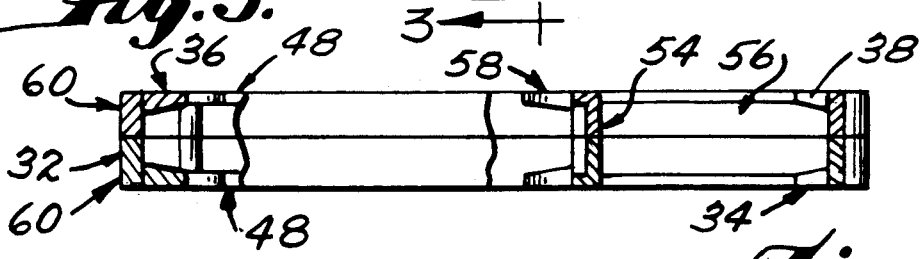
FIG. 3 is a cross-sectional detail take substantially on a line passing along 3—3 in FIG. 2.
Figure 7:
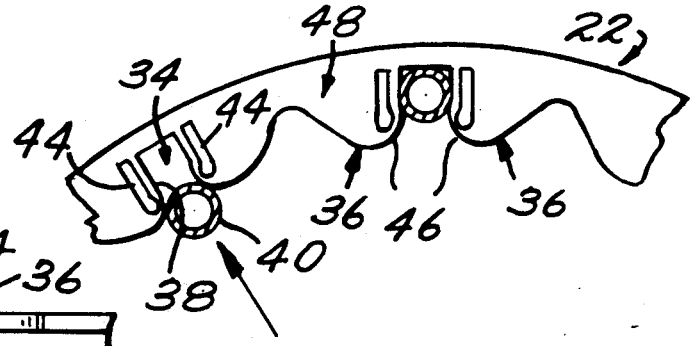
FIG. 7 is a schematic illustration of the positioning of golf club shafts within the retainers.
Figure 8:
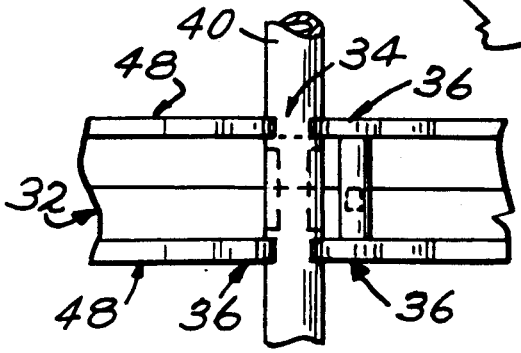
FIG. 8 is an elevational detail of a retainer-mounted shaft.

The rack 22, noting FIGS. 1-3 in particular, includes a peripheral wall 32 which, while preferably annular, can be of other configurations to conform to the interiors of particular golf bags. A series of club retainers 34 are provided about the inner periphery of the wall 32 and include upper and lower vertically spaced sets of gripping fingers 36. Each gripping finger 36 of each set of gripping fingers, includes a gripping wall 38 inwardly facing toward the pocket of the corresponding retainer 34, the wall 38 including a slightly concave inner surface providing a restricted mouth to the retainer pocket for the snap-engagement of the shaft 40 of a golf club 42 therein. This snap-engagement, best illustrated in FIG. 7, requires a resilient flexing of the inner gripping walls 38 which is enhanced by cavities 44 defined immediately inward thereof and into which the gripping walls 38 can resiliently deflect.

The formation of each retainer 34 with vertically spaced and aligned upper and lower sets of gripping fingers 36, is considered particularly significant in that a retained golf club is gripped at two vertically spaced points whereby a significant degree of lateral stability and resistance to pivotal shifting within the bag is achieved.

The fingers 36, to each side of each retainer 34 formed thereby present concave corner portions 46 to facilitate introduction and removal of the club shafts 40.

The gripping fingers 36, along with the aforedescribed components thereof and the retainers formed thereby, are integrally defined within vertically spaced upper and lower inwardly directed flanges 48 integral with the upper and lower edges of the peripheral wall 32.

Each of the flanges 48 is of a greater width, as at 50, between adjacent retainers 34 for a strengthening of the annular rack and the grip-defining fingers 36. While, as illustrated, the flange portions 50 can have the inner edge 52 thereof slightly recessed, providing a tapered configuration to the outer edges of the gripping fingers 36, the width of the flange portions 50 is still greater than that of the A crossbar or crosswall 54 spans the opening defined by the peripheral wall 32 to one side of the diametric center of the opening, dividing the opening into larger and smaller subdivisions with the smaller subdivision in turn centrally divided by a partition bar or wall 56 extending across the smaller opening subdivision centrally from and at right angles to the crosswall 54 and to the peripheral wall 32, thus dividing the small subdivision into two yet smaller areas. The crosswall 54 and partition wall 56 are of equal height with the peripheral wall 32. The crosswall 54 includes upper and lower vertically spaced integral flanges similar to the peripheral wall flanges 48 and similarly defining a series of retainers 58. The retainers 58 substantially duplicate the retainers 34, both in formation and manner of use.

Each of the two smaller subdivision areas, defined by the radially extending partition wall 56, include two retainers 34 defined therein. These retainers 34 are on a relatively greater spacing than the space between the retainers 58 or the retainers 34 about the major portion of the rack wall, the greater spacing allowing for an accommodation of the normally larger golf club woods.

Figure 4:
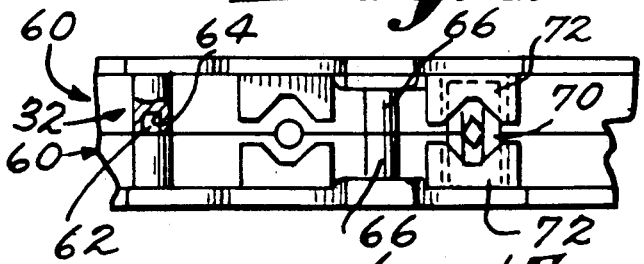
FIG. 4 is an elevation detail take substantially on a plane passing along 4—4 in FIG. 2.

As suggested in FIGS. 3 and 4 in particular, the rack, to facilitate the construction thereof, can be formed of duplicate upper and lower molded components 60 releasably interlocked, in facing relation to each other, by peripherally spaced pin 62 and bore 64 interlocks integrally formed about the inner face of the peripheral wall 32. Such interlocks, in addition to securing the two components 60 into a unitary rack structure, also act to rigidify the rack and the spaced parallel flanges 48 from which the retainers are defined.

The strength and structural stability of the rack is further enhanced by integral abutting columns 66 molded to each of the components 60 about the inner face of the peripheral wall 32 and along the corresponding face of the crosswall 54 with the columns of the two components vertically aligned and abutting each other. These columns 66 are preferably formed at the inner ends of the retainer pockets vertically between the flanges 48. Yet additional stability can be introduced into the rack by providing the flanges 48, along the full inner peripheries including the retainer fingers 36, with continuous depending lips for an enhanced thickness at these outer edges which are to be directly contacted by the clubs.

Figure 6:
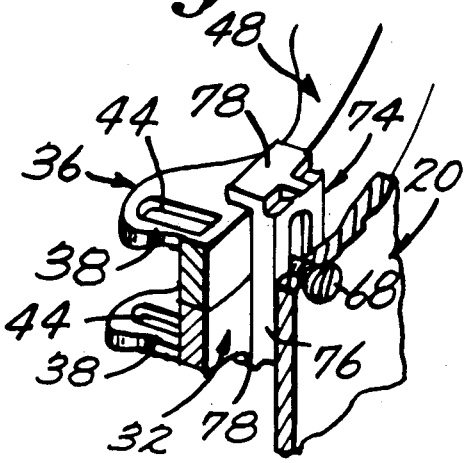
FIG. 6 is a perspective detail of the mounting of the rack utilizing a spacer.
Figure 5:
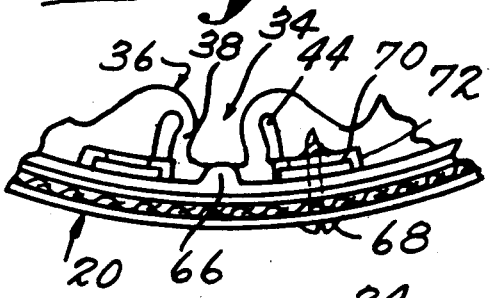
FIG. 5 is a top plan detail of the portion of the rack of FIG. 4 illustrating the manner of mounting to the golf bag.

Noting FIG. 1, the rack 22 is located within the upper portion of the bag 20. The exact positioning of the rack is accomplished by snapping a club shaft, preferably the wedge, into a retainer 34 with the club head clearing the top of the rack by approximately ⅛" minimum. The rack and club are then lowered into the bag until the club grip seats on the bag bottom or the base 24 positioned therein. The rack is secured within the bag by a plurality of screws 68 engaged through the bag and into appropriate fastener means such as Tinnerman fasteners 70 on the inner face of the peripheral wall 32. Such fasteners 70 can be mounted within opposed pockets 72 integrally formed on the opposed upper and lower rack components 60 as will be best noted in FIGS. 4 and 5. Noting FIG. 6, in order to accommodate slight variations in the diameter of the various bags 20 in which the rack may be mounted, appropriate spacers 74 can be provided between the bag 20 and the rack 22. Such spacers will be molded elements with a vertical centrally slotted portion 76 which engages directly against the outer rack wall 32, and upper and lower flanges 78 which respectively engage and overlie the upper and lower flanges 48 of the rack 22.

In positioning the rack 22 within the mouth or upper portion of the bag 20, the radially extending partition wall 56 is to align with a predetermined portion of the bag, for example the handle or strap 74.

With reference particularly to FIGS. 1 and 13–15, the base 24 is an integrally molded member with a planar base panel 80, normally circular or otherwise configured to conform to the interior of the bottom of a golf bag, and a pair of upwardly projecting slightly arcuate opposed ridges 82. Each of the ridges generally follows the curvature of opposed portions of the base panel 80 and have formed therein a plurality of vertically extending arcuate recesses 84 which define seats for the club grips. The seats 84 are generally equal in number to the number of retainers 34 and 58, and are to be vertically aligned therewith as shall be described presently. The elongate ridges 82 include central full-length ridge lines 86 with the recesses or seats 84 inclining downwardly and outwardly therefrom to both sides thereof to facilitate introduction and removal of the club grips. The opposed ends of the ridges 82 form partial recesses as at 88 which combine to define endmost seats between the opposed ridges, thus utilizing the full periphery of the base. As noted in FIG. 13, the central facing seats 84 of the two ridges actually define annular seats for reception of the grips of the clubs engaged within retainers 58 in the crossbar. In this manner, the central club grips are precluded from movement toward the surrounding clubs in all directions.

Figure 13:
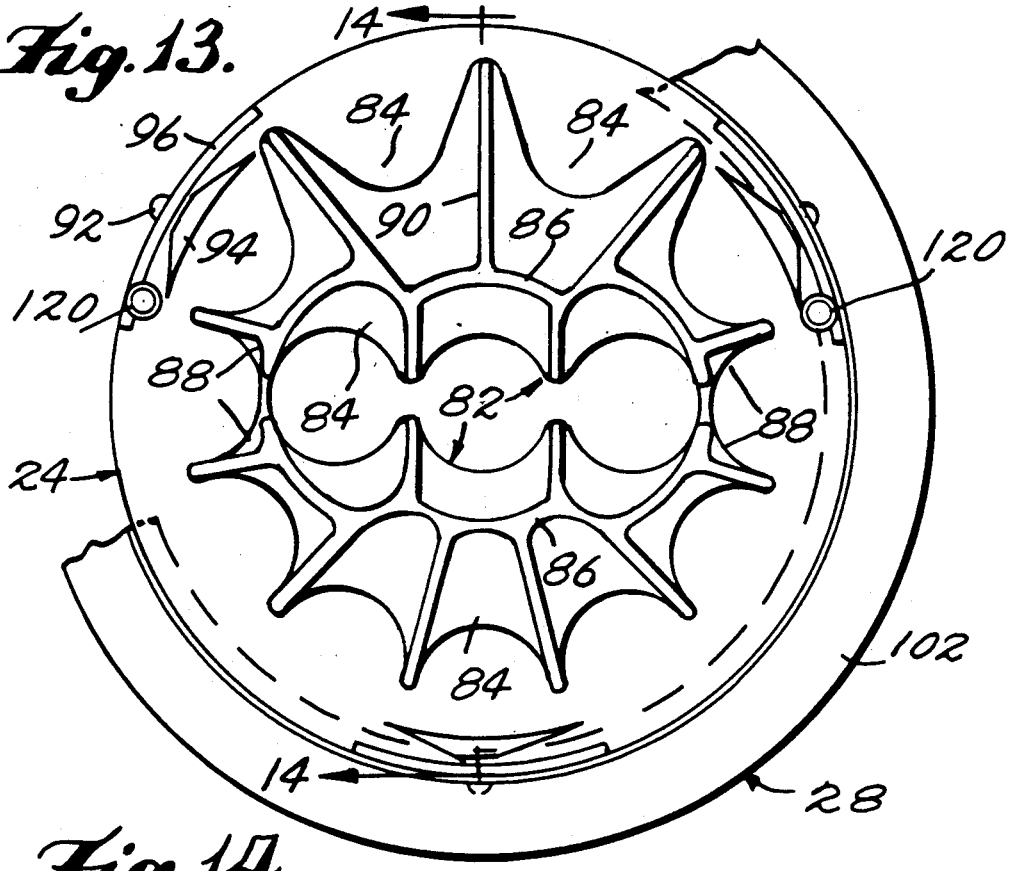
FIG. 13 is a top plan view of the base and adapter ring, with a portion of the adapter ring broken away.
Figure 14:
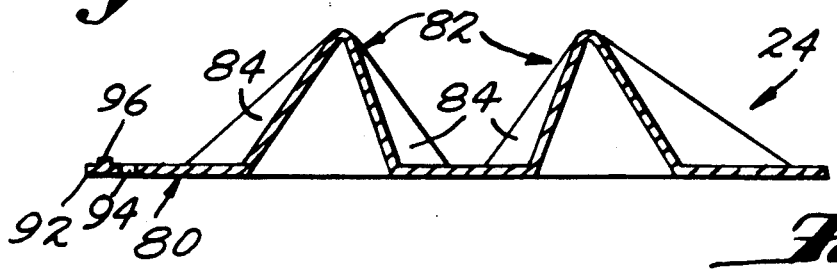
FIG. 14 is a cross-sectional view of the base taken substantially on a plane passing along line 14—14 in FIG. 13.

As will also be best seen in FIG. 13, one of the ridges 82, the uppermost ridge in the illustration, includes relatively larger recesses or seats 84 along with a central divider rib 90 between adjacent pockets 84 which is longer than the remainder of such divider ribs. This rib 90 is to be vertically aligned with the rack partition wall 56 and as such, will be aligned with the corresponding portion of the club, for example the handle or strap 74. In this manner, a proper orientation of the rack and base relative to each other, with the retainers and seats in vertical alignment, will be achieved with the larger seats accommodating the grips of the woods.

The base 24 is frictionally retained within the bottom of the bag 20, preferably by radially extending tabs 92 integral and coplanar with the base panel 80 at peripherally spaced points thereabout. The base panel 80 immediately inward of each of the tabs 92, is provided with a cut-out area 94 which provides for an enhanced flexibility of the edge of the base panel 80 adjacent the tabs 92 for facilitating the flexing and snap-locking of the tabs into engagement of the bag wall at the bottom thereof. As desired, a small arcuate reinforcing rib 96 can be provided along the panel edge portion between each position fixing tab 92 and the arcuate cut-out or opening immediately inward thereof.

Figure 15:
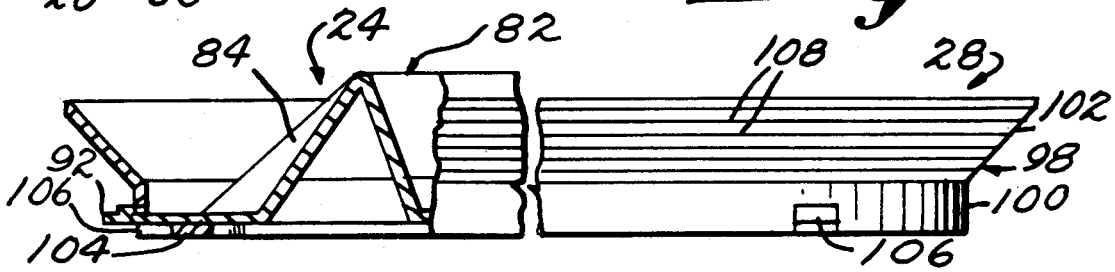
FIG. 15 is an elevational view, with portions broken away for purposes of illustration, of the adapter ring and base.

With particular reference to FIGS. 13 and 15, if the cross-sectional area of the bottom of the bag 20 is so large as to not provide for a locking or retention of the base 24 in position therein, the present invention also contemplates use of the adapter ring 28. This ring 28 includes a peripheral wall 98 comprising a lower vertical portion 100 conforming to the outer periphery of the base panel 80 and an upward outwardly flaring portion 102. The base 24 is received vertically downward into the adapter ring 28 with the base panel 80 seating on an inwardly directed support flange 104 peripherally about the lower edge of the lower portion 100.

In order to fix the base 24 within the adapter ring 28, the base panel tabs 92 are snap-engaged through corresponding openings 106 in the lower wall portion 100 with the inherent flexibility of the base panel 80, particularly as enhanced by the cut outs 94, allowing for this engagement of the tabs 92 through the apertures 106.

In order to enhance the range of bags within which the base can be accommodated, the adapter ring 98, and in particular the upper flared wall portion 102 thereof, is provided with annular guide lines 108 along which the wall portion 102 can be severed by any appropriate sharp instrument to adjust the circumference thereof to the bag within which it is to be engaged. The upwardly flared nature of the wall portion, even when cut to a smaller dimension, provides for a positive gripping of the interior of the bag wall against any tendency for the adapter ring, and hence the base, to upwardly displace. Similarly, it is contemplated that the proposed engagement will also prevent any tendency for the base to rotate from its initially set position.

Figure 16:
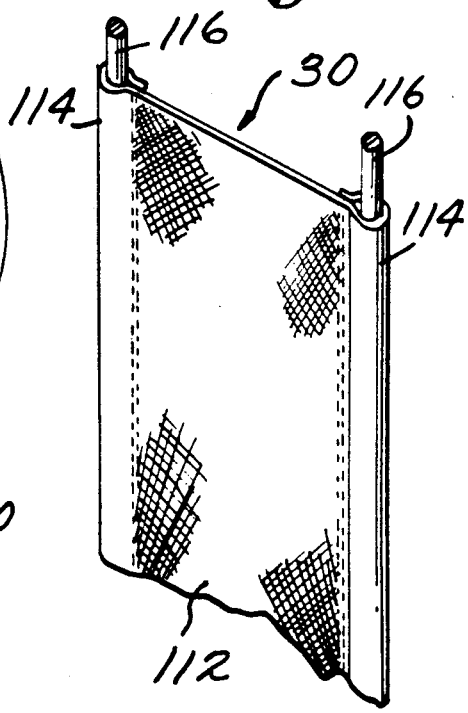
FIG. 16 is a perspective detail of the bag divider.

Noting FIGS. 1 and 16, if desired, the vertical divider 30 can be mounted between the rack 22 and the base 24 paralleling the crosswall 54. The divider 30 will preferably comprise a vertically elongate sheet 112 with open ended sleeves 114 defined along the opposed vertical edges thereof. The sleeves 114 in turn receive elongate rods 116, the opposed ends of which are received within hollow bosses 118 and 120 respectively on the rack 22 and base 24. The bosses 118 are formed integrally with the flanges 48 of the peripheral wall and are aligned with the opposed ends of the crossbar 54 on a line immediately inward of the crossbar retainers 58. On the base, the bosses 120 align with the opposed ends of the elevated ridge aligned with the crossbar 54.

A particularly significant feature of the invention is the traveling lock ring 26 illustrated in FIGS. 9–12. The lock ring 26 is specifically intended as a means for positively locking the club shafts 40 within the retainers 34 and 58 during periods of non-use, that is, when one is not playing golf and the bag may be subjected to forces which might tend to accidentally discharge the clubs from the retainer pockets. This may occur under such circumstances as in shipping the bag with the clubs therein, while driving with the clubs in the trunk or back of a vehicle, etc.

The lock ring 26 is annular or otherwise configured to conform to the shape of the rack 22 in overlying relation to the uppermost flange 48, and in particular the inner ends of the grip-forming fingers 36. The ring consists basically of a planar body 122 with an outer periphery overlying the upper flange 48 for support thereon. Recesses 124 are defined in this outer periphery and align with and across the open ends of the retainers 34 to selectively close these open ends upon a mounting of the lock ring 26 and to preclude withdrawal of the clubs.

In order to close the retainers 58 in the crossbar 54 of the rack 22, the lock ring also includes a crossbar 126, which, upon a mounting of the lock ring on the rack as illustrated in FIG. 11, lies across the open ends of the retainers 58. It will also be appreciated that the lock ring crossbar facilitates a proper alignment of the lock ring.

In order to mount the lock ring 26 to the upper flange 48 of the rack 22, the lock ring 26 is provided with peripherally spaced depending outwardly directed lugs 128. Each lug 128 is integrally formed with the ring body 122 thereover, preferably through an extension or radially outward enlarged portion 130 on the periphery of the ring to provide additional rigidity for the lug 128. Noting FIG. 12, the outwardly projecting leading end 132 of each of the lugs 128 includes a tapered face for snap-locking of the lugs 128 beneath the top flange 48 preferably in the relieved areas 50 between adjacent retainers 34. When so engaged, the corresponding extension 130 seats on the adjacent fingers 36 of an adjacent pair of retainers 34. As suggested in FIG. 12, the extensions 130 can have the upper surfaces thereof slightly recessed from the planar top of the ring body 122.

Notwithstanding the positive interlock achieved between the lock ring 26 and the rack 22 by the snap-engaged lugs 128, the ring is easily manually removed as desired through the inherent flexibility of the plastic ring which enables one to merely inwardly flex selected portions of the ring for a release of the lugs 128. Both the mounting of the ring and the release thereof, can be effected substantially instantaneously.

As desired, additional stability can be introduced into the ring through the provision of reinforcing ribs 134 at the opposed ends of the crossbar 126 and perpendicular thereto. Similarly, on the diameter of the ring 26 perpendicular to the crossbar 126, enhanced support will be provided at one end by the radial bar 56 of the rack 22 therebelow. At the other end, the lock ring can be provided with integral projecting tabs 136 adapted to overlie the upper surface of the upper flange 148 and provide an enlarged support surface.

In use, the base will be positioned and aligned within the lower portion of the golf bag, either with or without the adapter ring depending upon the relative sizes of the base and bag. Next, the rack, utilizing a golf club as a height gauge, will be positioned within the upper portion of the bag, properly aligned so as to correspond with the alignment of the base, and fixed in position by means of screws engaged through the bag and into the peripheral wall of the rack, utilizing spacers as required. The vertical divider, through the use of the removable side rods and the flexible wall panel, can be mounted, as desired, either before or as the rack is mounted. Finally, and with the clubs received within the bag and engaged within the rack, the traveling lock ring can be selectively mounted to effect a positive retention of the clubs until such time as the lock ring is manually removed.

The foregoing is considered illustrative of the principals of the invention, and variations thereof as may occur to those skilled in the art, are to be considered within the scope of the invention.

I claim:

1. A golf club organizer including a rack mountable within the upper portion of a golf bag, said rack being generally peripherally configures to conform to the interior of the golf bag, said rack having an inner periphery defining a central club-receiving opening, a plurality of inwardly opening spaced club retainers on and along said inner periphery about said opening, each retainer being adapted to receive and releasably retain a club, and crossbar means spanning said opening between and fixed to spaced portions of said inner periphery, said crossbar means dividing said opening into larger and smaller subdivisions, said crossbar means including retainers opening inwardly to the larger subdivision of said opening, said crossbar means further including a crossbar parallel to and laterally spaced from a diameter of said opening and extending between linearly aligned opposed portions on said rack to define said larger and smaller subdivisions, and a partition wall extending from a point centrally of said crossbar radially across the smaller subdivision to the inner periphery of the rack whereby the smaller subdivision is divided into yet smaller opening areas, each of which contains at least one of said retainers on the inner periphery of the rack.

2. The golf club organizer of claim 1 wherein each retainer comprises vertically spaced upper and lower releasable gripping means adapted to engage a received club at vertically spaced points therealong.

3. The golf club organizer of claim 2 including lock means, means for releasably engaging said lock means with said rack across and immediately inward of each of said retainers for precluding of removal of retainer-received clubs, said lock means being manually removable from said rack for an opening of said retainers for selective removal and introduction of clubs into said retainers.

4. The golf club organizer of claim 3 wherein said lock means comprises a lock ring generally conforming to the inner periphery of the rack, said lock ring overlying inner portions of said gripping means peripherally about said opening and along said crossbar.

5. A golf club organizer including a rack mountable within the upper portion of a golf bag, said rack being generally peripherally configured to conform to the interior of the golf bag, said rack having an inner periphery defining a central club-receiving opening, a plurality of inwardly opening spaced club retainers on and along said inner periphery about said opening, each retainer being adapted to receive and releasably retain a club, and crossbar means spanning said opening between and fixed to spaced portions of said inner periphery, said crossbar means dividing said opening into larger and smaller subdivisions, said crossbar means including retainers opening inwardly to the larger subdivision of said opening, each retainer comprising vertically spaced upper and lower releasable gripping means adapted to engage a received club at vertically spaced points therealong, and lock means, means for releasably engaging said lock means with said rack across and immediately inward of each of said retainers for precluding removal of retainer-received clubs, said lock means being manually removable from said rack for an opening of said retainers for selective removable and introduction of clubs into said retainers.

6. A golf club organizer including a generally annular rack mountable within the upper portion of a golf bag, said rack having an inner periphery defining a central club-receiving opening, a plurality of spaced club retainers on and along said inner periphery of the rack, each retainer being adapted to receive a club shaft immediately below the head of the club and releasably retain a received club shaft therein, each retainer comprising closely spaced upper and lower releasable gripping means on said rack each adapted to engage a received club at vertically spaced points therealong, and within the upper portion of a golf bag, each said gripping means comprising a pair of opposed gripping fingers inwardly directed relative to said inner periphery and defining an inwardly directed club receiving mouth for selective engagement of a club shaft therethrough into releasable gripping engagement by said gripping fingers.

7. A golf club organizer including a generally annular rack mountable within the upper portion of a golf bag, said rack having an inner periphery defining a central club-receiving opening, a plurality of inwardly opening spaced club retainers on and along said inner periphery, each retainer being adapted to receive and releasably retain a club shaft therein, each retainer comprising vertically spaced upper and lower releasable gripping means adapted to engage a received club at vertically spaced points therealong, said organizer further including lock means, means for releasably engaging said lock means with said rack cross and immediately inward of each of said retainers for precluding removable of retainer-received clubs, said lock means being manually removable from said rack for an opening of said retainers for selective removal and introduction of clubs into said retainers.

8. The golf club organizer of claim 9 wherein said lock means comprises a lock ring generally conforming to the inner periphery of the rack, said lock ring overlying inner portions of said gripping means peripherally about said opening.

9. A golf club organizer including a generally annular rack mountable within the upper portion of a golf bag, said rack having an inner periphery defining a central club-receiving opening, a plurality of inwardly opening spaced club retainers on and along said inner periphery about said opening, said retainers being adapted to receive and releasably retain golf clubs, and lock means, means for releasably engaging said lock means with said rack across and immediately inward of each of said retainers for precluding removal of retainer-received clubs, said lock means being manually removable from said rack for an opening of said retainers for selective removal and introduction of clubs into said retainers.

10. The golf club organizer of claim 9 wherein each retainer includes at least one set of spaced inwardly directed gripping fingers defining a club receiving mouth inward of the rack inner periphery for selective engagement of a club shaft therethrough, said lock means comprising a ring overlying said fingers adjacent the defined mouth of each retainer and selectively closing the mouth of each retainer to preclude outward movement of a received club shaft therethrough.

11. A golf club organizer including a generally annular rack mountable with the upper portion of a golf bag, and a base mountable within the lower portion of a golf bag, said rack having an inner periphery defining a central clubreceiving opening, a plurality of inwardly spaced club retainers on and along said inner periphery about said opening, each retainer being adapted to receive and releasable retain a golf club, said base including a plurality of upwardly directed seats defined therein for the selective receiving and retaining of the grip ends of retainer-received clubs, said base seats being vertically aligned with said rack retainers, including lock means, and means for releasably engaging said lock means with said rack across and immediately inward of each of said retainers for precluding removal of retainer-received clubs, said lock means being manually removable from said rack for an opening of said retainers for selective removable and introduction of clubs into said retainers.

12. The golf club organizer of claim 11 including means for vertically aligning the retainers on said rack with the seats on said base, said means for aligning said rack retainers with said base seats comprising a crossbar component on said rack and a divider between selected adjacent seats on said base, both alignable with a predetermined section of an organizer-receiving golf bag.

13. The club organizer of claim 11 wherein said base includes a pair of slightly arcuate upwardly directed ridges, said seats being defined within and vertically along said ridges.

14. The club organizer of claim 13 including an adapter ring engaged about said base for retention of said base within said bag, said adapter ring including a generally annular outwardly flared upwardly directed wall adapted to engage the interior of a golf bag and preclude upward withdrawal of the base therefrom.

15. A golf club organizer including a rack mountable within the upper portion of a golf bag, said rack being generally configured for reception within the interior of the golf bag, said rack having an inner periphery defining a central club-receiving opening, a plurality of inwardly opening spaced club retainers on and along said inner periphery about said opening, each retainer being adapted to receive and releasably retain a club, and crossbar means spanning said opening between and fixed to spaced portions of said inner periphery, said crossbar means dividing said opening into larger and smaller subdivisions, retainers on said crossbar means opening inwardly to the larger subdivision of said opening, said crossbar means including a crossbar parallel to and laterally spaced from a diameter of said opening and extending between linearly aligned opposed portions on said rack and dividing said opening into larger and smaller subdivisions, and a partition wall extending from a point centrally of said crossbar radially across the smaller subdivision to the inner periphery of the rack whereby the smaller subdivision is divided into yet smaller opening areas, each of which contains at least one of said retainers on the inner periphery of the rack.

16. A golf club organizer including a generally annular rack mountable within the upper portion of a golf bag, said rack having an inner periphery defining a central club-receiving opening, a plurality of spaced club retainers on and along said inner periphery about said opening, said retainers being adapted to receive and releasably retain golf clubs, and lock means, means for releasably engaging said lock means with said rack across of each of said retainers for precluding removable of retainer-received clubs while said lock means is engaged with said rack, said lock means being manually releasable from said rack for an opening of said retainers for selective removal and introduction of clubs into said retainers.

17. The golf club organizer of claim 16 wherein each retainer includes at least one set of spaced inwardly directed gripping fingers defining a club receiving mouth inward of the rack inner periphery for selective engagement of a club shaft therethrough, said lock means comprising a ring overlying said fingers adjacent the defined mouth of each retainer to preclude selectively closing the mouth of each retainer to preclude outward movement of a received club shaft therethrough.

* * * * *

UNITED STATES PATENT AND TRADEMARK OFFICE

CERTIFICATE OF CORRECTION

PATENT NO. : 5,029,703

DATED : July 9, 1991

INVENTOR(S) : Kenneth W. Dulyea, Sr.

It is certified that error appears in the above-identified patent and that said Letters Patent is hereby corrected as shown below:

Column 7, line 8, "configures" should read --configured--.

Column 8, line 32, "cross" should read --across--.

Column 8, line 38, "9" should read --7--.

Column 9, line 14, "removable" should read --removal--.

Column 10, line 36, "to preclude" should read --and--.

Signed and Sealed this

Twenty-ninth Day of October, 1991

*Attest:*

HARRY F. MANBECK, JR.

*Attesting Officer*

*Commissioner of Patents and Trademarks*